US005560505A

United States Patent [19]

Schneider et al.

[11] Patent Number: 5,560,505

[45] Date of Patent: Oct. 1, 1996

[54] CONTAINER AND STOPPER ASSEMBLY LOCKED TOGETHER BY RELATIVE ROTATION AND USE THEREOF

[75] Inventors: Bernard Schneider; René Hoslet, both of Sainte Menehould, France

[73] Assignee: CEBAL SA, France

[21] Appl. No.: 267,209

[22] Filed: Jul. 6, 1994

[30] Foreign Application Priority Data

Jul. 9, 1993 [FR] France ..... 93 08728

[51] Int. Cl.[6] ..... B65D 41/04

[52] U.S. Cl. ..... 215/330; 215/216; 215/238; 215/331; 215/334; 222/556; 222/562; 222/153.09

[58] Field of Search ..... 215/216, 235, 215/237, 238, 307, 330, 331, 334; 220/254, 315; 222/153, 556, 562

[56] References Cited

U.S. PATENT DOCUMENTS

| | | | |
|---|---|---|---|
| 4,310,101 | 1/1982 | Sekine | 215/331 X |
| 4,781,311 | 11/1988 | Dunning et al. | 222/153 |
| 5,046,630 | 9/1991 | Schneider et al. . | |
| 5,143,234 | 9/1992 | Lohrman et al. | 215/235 |
| 5,145,080 | 9/1992 | Imbery, Jr. | 215/331 |
| 5,279,434 | 1/1994 | Aguirrezabal | 215/331 |

FOREIGN PATENT DOCUMENTS

| | | |
|---|---|---|
| 1268262 | 6/1961 | France . |
| 1387572 | 3/1975 | United Kingdom . |
| 2189475 | 10/1987 | United Kingdom . |
| 8400505 | 2/1984 | WIPO . |
| 9303972 | 3/1993 | WIPO . |

*Primary Examiner*—Stephen K. Cronin
*Attorney, Agent, or Firm*—Dennison, Meserole, Pollack & Scheiner

[57] ABSTRACT

A container and stopper assembly with the container having a head comprising a neck connected by a shoulder to a body of the container. The stopper and the head have respective complementary locking portions for locking by rotation. The locking portions are an elastically flexible axial blade carried by the stopper and axial portions carried by the shoulder. The axial portions include a first portion for catching and retaining the blade and a second portion for abutment of the blade ensuring that it is retained by the first portion and between the two portions.

15 Claims, 5 Drawing Sheets

CONTAINER AND STOPPER ASSEMBLY LOCKED TOGETHER BY RELATIVE ROTATION AND USE THEREOF

The present invention relates to a container and stopper assembly, said container having a head comprising a neck extended by a shoulder which connects this neck to a body or a skirt, said stopper and said head having respective complementary interlocking means with respect to rotations of the stopper relative to the container.

The document GB-A-2189475=FR-A-2597838 describes an assembly of this type in which said locking means also comprise a flexible axial blade elastically carried by the stopper and profiled axial portions carried by the shoulder, these profiled portions comprising a first portion having a first wall which is inclined relative to a diametral axial plane of the container passing through it, against which the blade will slide while being elastically deformed when the stopper is set into rotation, the blade then dropping by elastic return into a space between said portion and a second profiled axial portion against which the blade abuts, thus being locked in relative rotation.

This locking is therefore obtained by means of elastic deformation of the skirt of the cap and, in the case of a cap having a lid which opens by pivoting round an articulation, the orientation of this articulation and of the opening of the lid is fixed relative to the container. In practice, however, this lock is not sufficiently secure as it can be released by force with deformation of the skirt.

The Applicants have attempted to develop an assembly of this type with means for locking in a relative position by rotation which are much more secure and allow only very slight or zero angular play.

STATEMENT OF THE INVENTION

The invention relates to an assembly of the type known from the cited document which is characterised in that a) the blade is fixed beneath the base of the stopper and is free beneath its fixing b) the first portion comprises a second wall forming with the inclined wall a V-shaped notch turned toward the second abutment portion and said inclined wall ends with a terminal lateral edge on which the blade will catch by elastic return at the end of its sliding against said inclined wall while dropping into said space between the V-shaped notch and the abutment portion;

c) the second wall of the first portion ends at a distance from the second abutment portion smaller than the circumferential width of the blade, the blade dropped into said space then being trapped on all sides between the profiled portions.

After dropping, the blade is contained between the profiled portions preferably over at least 4 mm in height along the axis. These portions are typically axial and fixed on the shoulder, spaced from the neck and the skirt of the stopper and also from the skirt or body of the container. The position of the blade between the profiled portions is surprising and very secure.

When installed, the elastically flexible blade catches on one end of the inclined wall of the first portion or retaining portion and, by elastic return, it is accommodated between the second abutment portion and the retaining portion opposite its V-shaped notch, the abutment portion thus preventing the blade from escaping from the retaining portion. The blade mates with the profiled axial portions carried by the shoulder, violation of this locking is not possible and the angular play of the blade and therefore of the stopper inside this type of lock is typically of an angle of less than 3°.

The locking position of the blade is even more tamper-proof if the terminal lateral edge of the inclined wall is located toward the interior of the shoulder behind the blade in the caught, that is locked, position.

The container is preferably made of mouldable material, for example of glass or of aluminium or of plastics material, its head may be moulded separately and fixed on the body or the skirt by an appropriate means, for example by adhesion, catching, friction welding, induction welding. The stopper is preferably made of elastically deformable plastics material typically comprising a moulded part fixed on the container to allow the rotation thereof, this part carrying the longitudinal blade.

To facilitate the catching of the blade on the terminal lateral edge of said inclined wall, the profiled axial portions are preferably made of plastics material which is moulded integrally with the head, the first inclined wall having a thickness which decreases in the direction of its terminal lateral edge and is therefore elastically flexible.

It can be seen that the catching is facilitated by local bending toward the interior of the V and that the reverse deformation toward the exterior of the V would be more difficult in itself and too difficult to cause.

The flexibility of the end of the inclined wall allows a reduction in the stress and therefore in the torque corresponding to catching and it contributes to the inviolability which is excellent.

For construction, which has to allow for the width of the shoulder, and for the perfect sliding of the front of the blade against the first inclined wall, this first wall preferably has, on the side external to the V-shaped notch, a surface for engagement of said blade which is inclined at 40° to 50° to said diametral axial plane, said blade having at the front a lateral bevel for engagement of said surface having an inclination greater than the inclination of said engagement surface and comprised between 45° and 55°. Therefore, the front of the blade will slide easily, this blade simultaneously being elastically deformed toward the interior of the stopper until it catches and springs back by elastic return.

Generally speaking, the blade is preferably circumferentially rigid and radially flexible with a circumferential or traverse width of 24° to 32° and a thickness of 2 to 3 mm.

The complementary means described hereinbefore may be employed either alone or together in combination with the previous means, in particular to improve the inviolability of the lock according to the invention:

a) the blade preferably has a rear internal lateral bevel allowing it to enter further into said V-shaped notch, and the distance between the end of the second wall and the abutment position is at most equal to the circumferential or traverse width of the blade less 4° or at most equal to 20° if this width of the blade is 24° to 32°;

b) said first wall of the profiled catching and retaining portion ends at a distance from the abutment portion which is 1° to 3° less than said circumferential width of the blade;

c) the second wall is extended to the abutment portion and is continuous with it, further improving the inviolability and facilitating the production of the container, the profiled axial portions forming a single large portion which, in a cross section, has the appearance of a marine half anchor (cut through its axis of symmetry);

d) the blade preferably has, at its lower end, a bevel facing the exterior of the stopper thus allowing this blade to escape from a random axial engagement resting on the abutment portion.

Generally speaking, it can be mentioned that, to achieve simple, rigid locking, the blade typically has a height of 6 mm or more and engages between the profiled portions over at least ⅔ of its height.

To facilitate production, it is also preferable for said stopper to be of PP or of PE.HD and for said head of the container to be of polyolefin.

According to a first category of applications, the stopper is fixed on the container, for example on its neck by being driven until it abuts or catches, the stopper then being at a constant or almost invariable level and being able to turn round the container in one and/or other direction. If rotation is possible in both directions, it is possible to have two profiled members of which the V-shaped notches face one another, each of these retaining members forming an abutment for the blade in one of the two directions of rotation and the two members together allowing the catching and the locking of this blade. If the stopper is a service cap, that is a cap comprising a fixed base and a lid pivoting between lugs or round a hinge and, in the open position, exposing a distribution orifice in the lid or in the base, this base carries the lock blade.

According to a second category of applications, the stopper may be of the rapid screw type, typically in less than one and a half turns. The blade which is preferably equipped with a bevel allowing it to escape moderate pressure on the axial abutment portion locks at the end of the turn following this pressure.

Industrial use of the stopper and container assembly in a stoppering installation, that is for fixing of the stopper on the container, has been found very advantageous: the stopper is driven on the neck of the container, then this stopper is rotated relative to the container until a selected standstill torque proving said lock is obtained.

The rates obtained are 2.5 to 3 times faster than with stoppers orientated by the method previously described by the Applicants in EP-A-0410913=U.S. Pat. No. 5,046,630.

ADVANTAGES OF THE INVENTION

Definitive and tamper-proof locking.

Very low circumferential orientation play of less than 3°.

Allows high rate of stoppering in series.

EXAMPLES

FIRST EXAMPLE (FIGS. 1 to 5)

Figure 1:
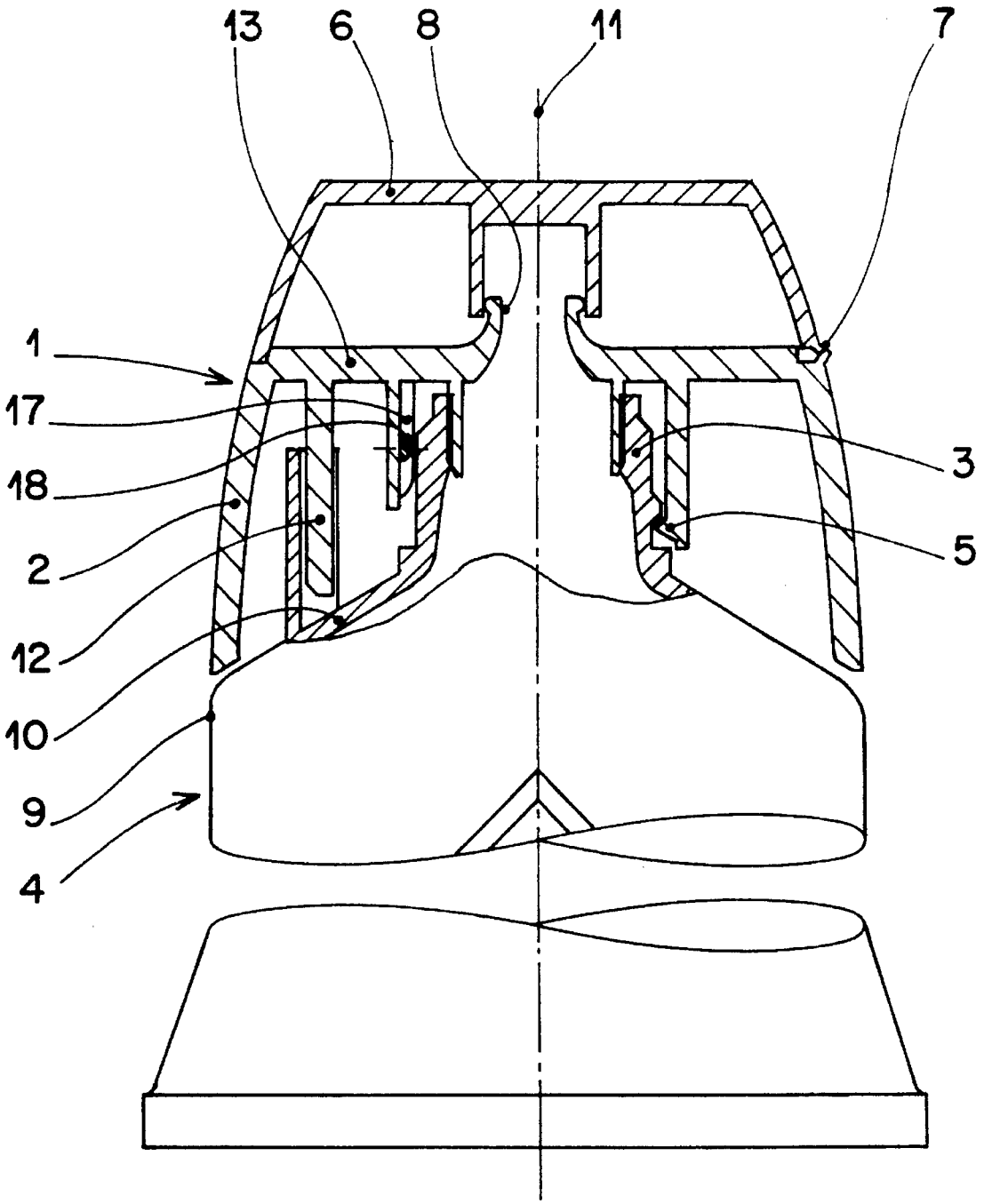
FIG. 1 shows a stopper and container according to the invention in an axial section of the stopper and of the head of the container.

The stopper 1 in FIG. 1 is a service cap 1 having a base 2 caught on the neck 3 of the container 4 by a discontinuous rib 5 and a lid 6 having a hinge 7 allowing a distribution orifice 8 in the base 2 to be stopped and opened. The base 2 has a depending skirt portion. The neck 3 is connected to the skirt 9 of the container 4 by an annular shoulder 10 inclined at 30° to the horizontal plane, the longitudinal axis 11 of the stopper 1 and of the container 4 being assumed to be axial with the stopper at the top.

The shoulder 10 extends between the diameter of 26 mm of the base of the neck 3 and the diameter of 50 mm of the skirt 9. The blade 12 fixed beneath the top 13 of the base 2 having a thickness of 1.2 mm has a height of 12 mm, a thickness of 2.5 mm and a circumferential width of 30° that is an overall width of 7 mm. The blade 12 is locked over 9 mm of height inside the profiled axial portions 14 and 15 carried by the shoulder 10: the axial section being drawn in the plane AA shown in FIG. 2, it can be seen that the blade 12 is protected on the exterior by the second wall 16 of the first profiled portion 14 (FIG. 2) and has in front of itself the profiled abutment portion 15, the portions 14 and 15 together forming the locking means carried by the shoulder 10. The base 2 is guided in a precise manner on the neck 3 by ribs 17 having a total angle of 60° ending with a flattened region having a width of 0.4 mm, as shown in local section 18. The stopper is of PP and the head 3 and 10 of the container 4 of PE.HD, the stopper and the head both being injection moulded.

Figure 2:
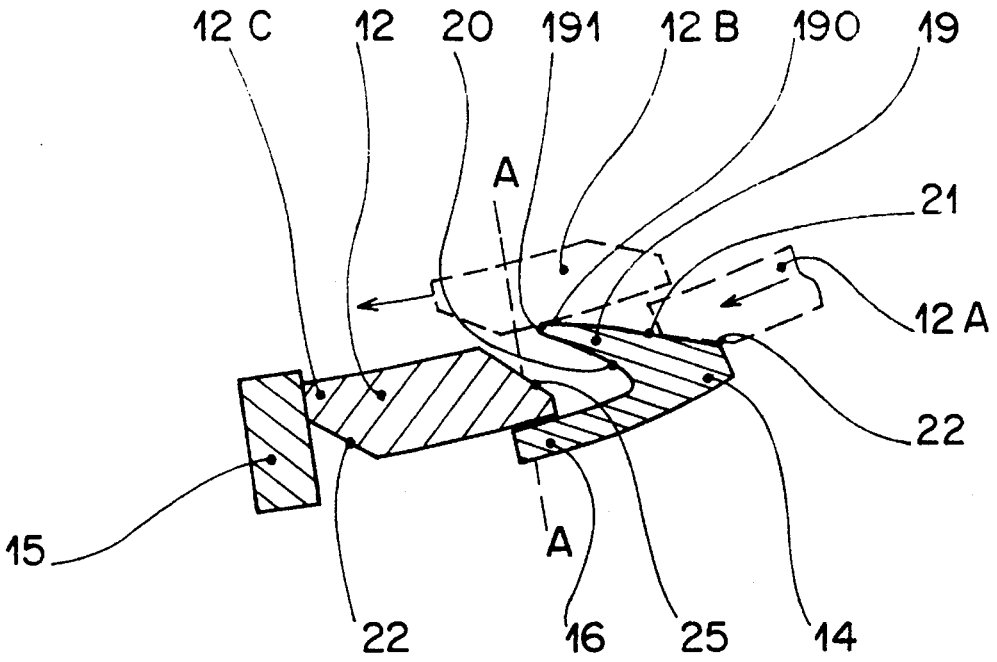
FIG. 2 shows the locking of a blade carried by the stopper between the profiled axial portions carried by the shoulder of the container in a section perpendicular to the axis.

FIG. 2 shows the method of locking the blade 12 more clearly. The first wall 19 of the profiled portion 14 is inclined and forms a V-shaped notch 20 with the second wall 16. The surface 21 of the first wall 19 which is external to the notch 20 is inclined at 45° to a radial plane and acts as an engagement surface 21 with progressive bending of the blade 12. The blade has a bevel 22 at its front edge inclined by 2° more on the radial plane than the inclined surface 21 so as to slide well on this surface 21 which causes it to bend (position 12A in the figure).

In position 12B, rotation has advanced and the bending of the blade 12 resting on the end 190 of the first wall 19 is at its maximum. The wall 19 thins progressively from a thickness of 1 mm at its root to a thickness of 0.3 mm at its terminal edge 191. The bending of the end 190 will facilitate the catching of the blade 12 under the influence of its elastic return. The blade has a rear bevel 25 enabling it to enter further into the V-shaped notch 20 after catching. The V-shaped bevel simultaneously facilitates this catching. In position 12C, the blade has caught and abuts on the abutment portion 15. It has resumed its relaxed form and cannot escape from the notch 20, the circumferential distances between the first wall 19 and the abutment portion 15 on the one hand and between the second wall 16 having a thickness of 0.8 mm and said abutment portion 15 being 20° and 23° respectively.

Figure 3:
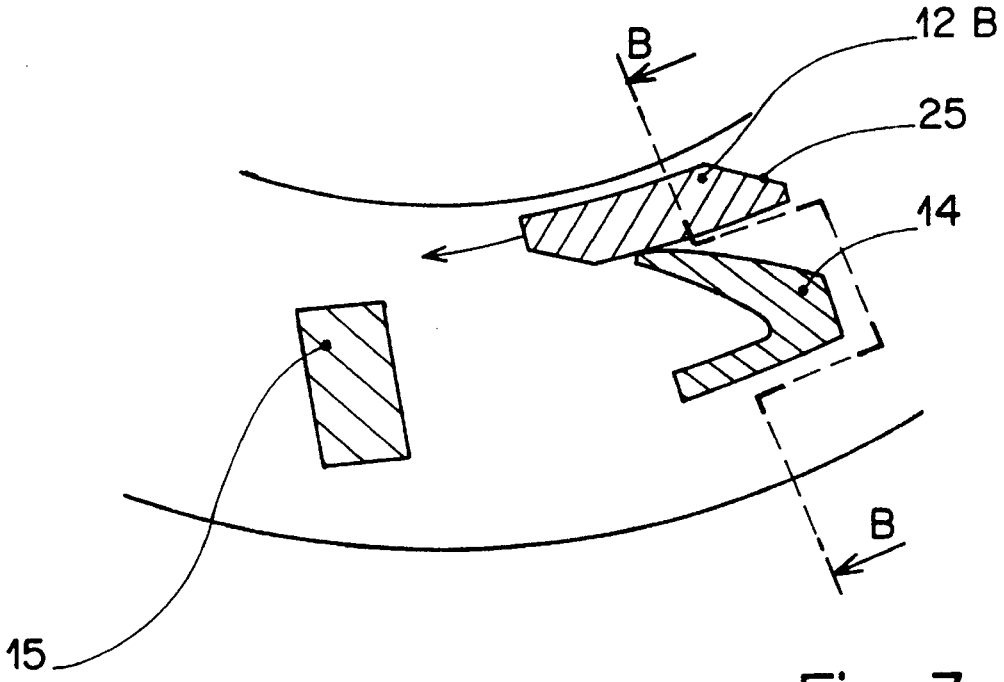
FIG. 3 shows the preparation of the catch with the previous sectional mode in the situation above the shoulder.

FIG. 3 shows position 12B of the blade 12 located on the shoulder 10.

Figure 4:
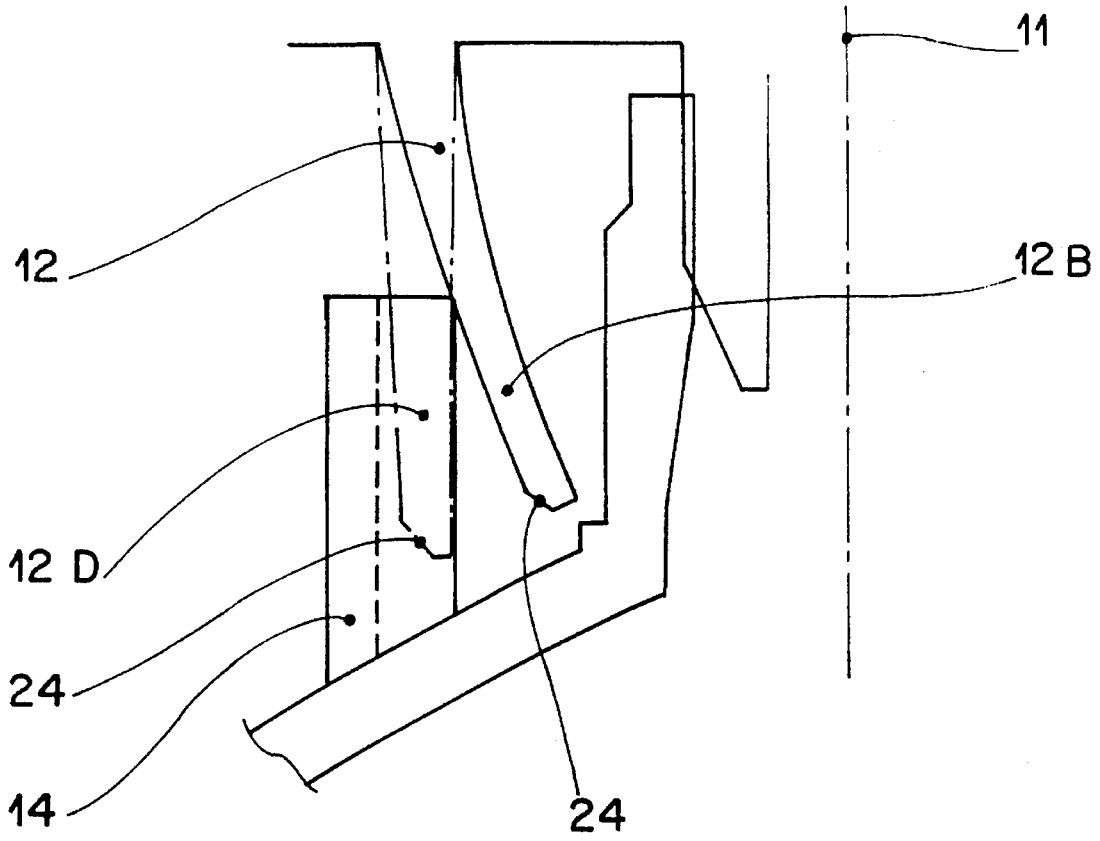
FIG. 4 shows the same stage as FIG. 3 in an axial half section as well as the position of the blade before its engagement on the first profiled portion.

According to the external plans BB labelled in FIG. 3, FIG. 4 shows the bending of the blade 12 in position 12B and, as a comparison, its position 12D before engagement with the first profiled portion 14. It explains the force of the elastic return for the catching of the blade 12. The bevel 24 at the lower end of the blade 12 allows an escape, by sliding and bending, from a random pressure by this blade on the top of the abutment portion 15.

Figure 5:
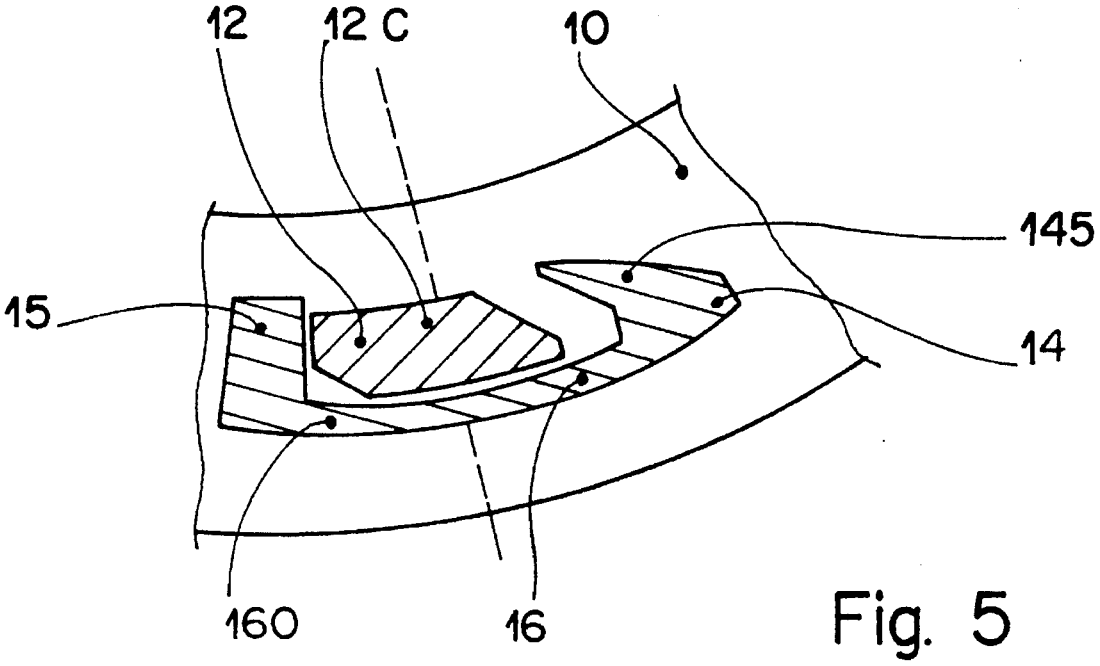
FIG. 5 shows the blade locked inside profiled axial portions forming a single large portion in a section perpendicular to the axis.
Figure 6:
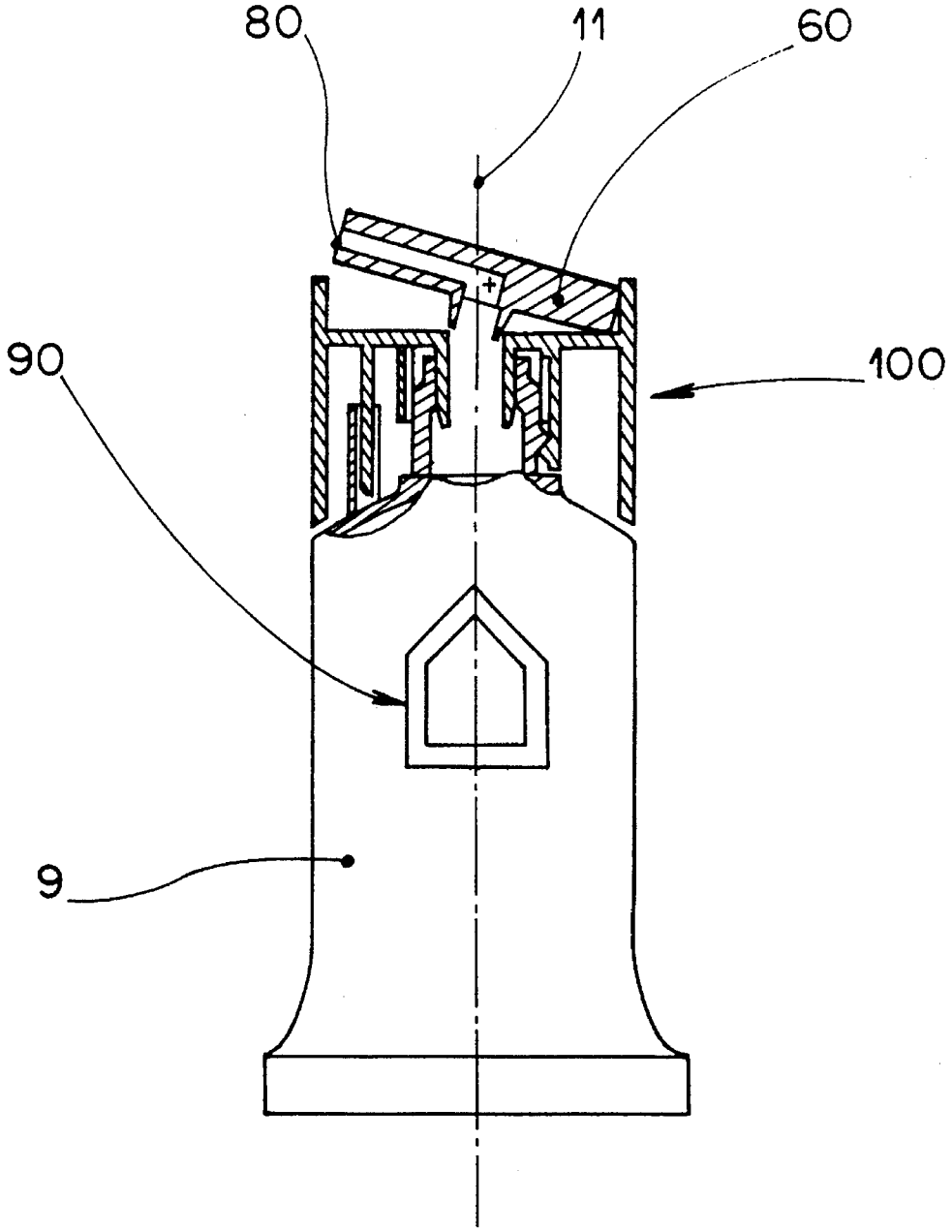
FIG. 6 shows a second stopper and container assembly according to the invention in an axial section of the stopper and of the head of the container.
Figure 7:
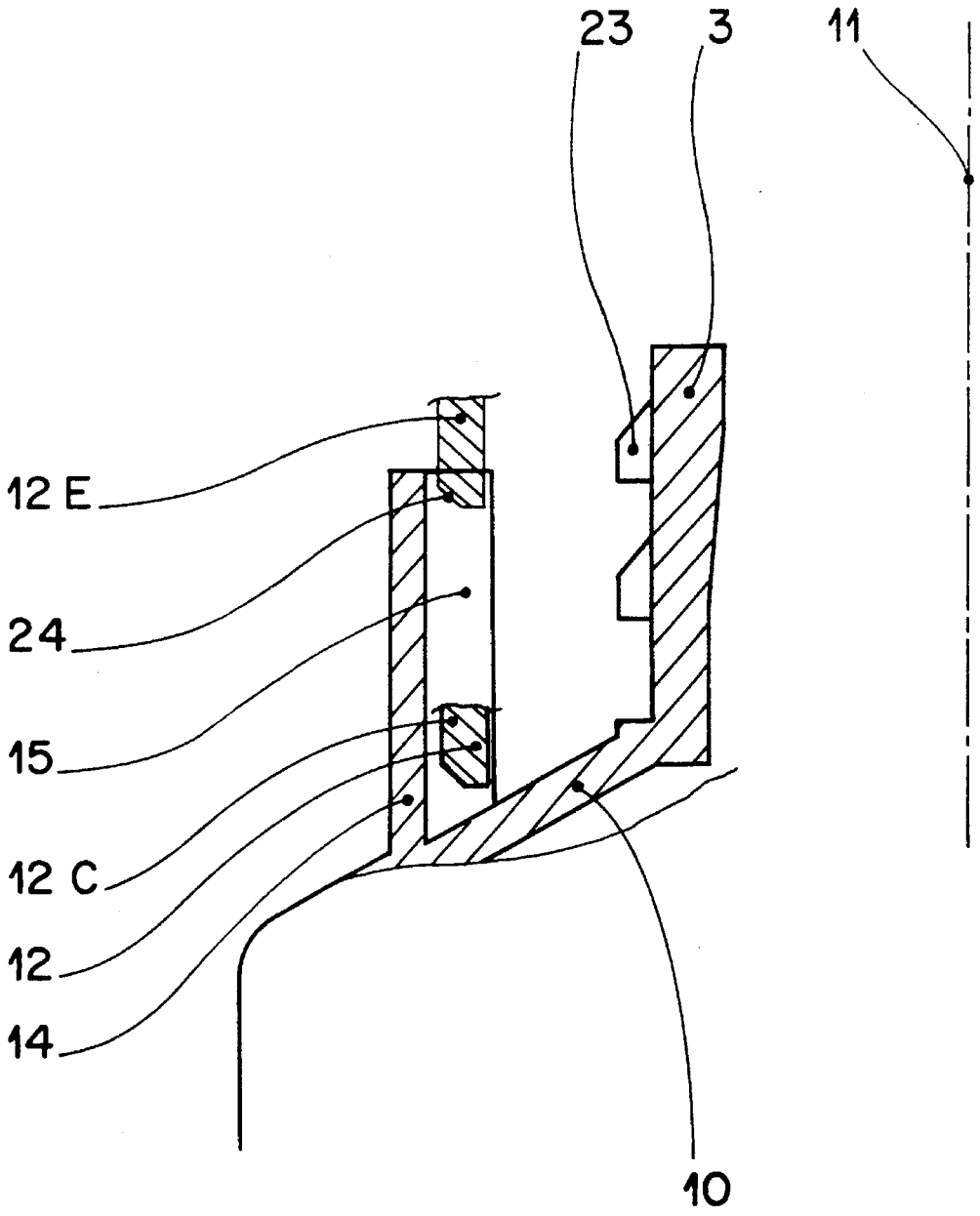
FIG. 7 shows a container and a stopper having a screw thread according to the invention, the stopper being marked by two positions of its locking blade in an axial half section.

FIG. 5 corresponds to position 12C in FIG. 3, the profiled axial portions 14 and 15 being joined by the wall 16 having a thickness of 0.6 mm which forms a continuous wall 160 with the abutment portion 15. Moulding is facilitated and inviolability is improved. The cross section of the large profile 145 thus formed curiously resembles a marine half anchor. In this case and generally speaking the large profile 160 or the profiles 14 and 15 may be arranged so as to achieve locking of the blade from the exterior, the elastic bending of the blade 12 toward the exterior thus ending with the catching and in the same locked position as before.

SECOND EXAMPLE (FIG. 6)

The lid 60 of the service cap 100 is mounted pivotally between lugs. The distribution orifice 80 in the lid 60 is orientated with precision relative to the decoration 90 of the skirt 9. The blade 12 is locked as in the first example (FIG. 1).

THIRD EXAMPLE (FIG. 7)

This is a screw stopper which may be screwed onto the rapid thread 23 of the neck 3 in one and a half turns. The axial section in the Figure cuts through the locked position 12C of the blade 12. One turn before, the blade 12 does not yet have to be definitively engaged between the profiled locking portions 14 and 15 carried by the shoulder 10, it can at most rest against the abutment portion 15 and escape there by bending at 12E owing to the bevel 24 of its lower end, then return into its relaxed position to perform slightly less than one turn until it engages with the portion 14 leading to the locked position 12C.

INDUSTRIAL APPLICATION

All containers with catch-type or rapid screw-type stoppers which have to be orientated with precision and to be tamper-proof relative to the decoration or geometry of the container.

We claim:

1. Assembly of a container (4) and a stopper (1), said container (4) having a body (9), and a head (3 and 10) comprising a neck (3) and shoulder (10), the head being connected by the shoulder (10) to the body (9), the stopper (1) and the head (3 and 10) having respective complementary interlocking means selectively engaged by rotation of the stopper (1) relative to the container (4) about an axis of rotation, said interlocking means comprising an axial blade (12) carried by the stopper (1) and profiled axial portions (14, 15) carried by the shoulder (10), these profiled portions comprising a first portion (14) having a first inclined wall (19) which is inclined relative to a diametral axial plane of the container traversing it, against which the blade (12) will slide while being elastically deformed as the stopper (1) is rotated, the blade (12) then dropping by elastic return into a space between said first portion (14) and a second profiled axial abutment portion (15) against which the blade (12) abuts, the blade thus being locked in relative rotation, characterized in that:

a) the stopper has a base with a depending skirt portion, the blade (12) has a first end fixed to the base of the stopper with the blade depending freely therefrom, the blade being radially flexible;

b) the first portion (14) comprises a second wall (16) forming with the inclined wall (19) a V-shaped notch (20) facing toward the second abutment portion (15), said inclined wall (19) ending with a terminal lateral edge (191) on which the blade (12) will engage by elastic return as the blade, sliding against said inclined wall (19), reaches said terminal lateral edge, said blade, by a flexing thereof, dropping into a caught position in said space between the V-shaped notch (20) and the abutment portion (15);

c) the blade having a transverse width, the second wall (16) of the first portion (14) ends at a distance from the second abutment portion (15), said distance being less than the transverse width of the blade (12), the blade (12) dropped into said space being trapped on all sides between the profiled portions (14 and 15).

2. Assembly according to claim 1, in which the terminal edge (191) of the inclined wall (19) is located radially inwardly of the blade (12) in the caught position.

3. Assembly according to claim 1, in which the container (4) is formed from a mouldable material and the stopper (1) is formed from an elastically deformable plastics material.

4. Assembly according to claim 3, in which the profiled axial portions (14, 15) are formed from a plastics material and formed integral with the head (3 and 10), said first inclined wall (19) of the first portion (14) having a thickness which decreases in the direction of its terminal lateral edge (191) and is elastically flexible.

5. Assembly according to claim 1 in which said first wall (19) has an inclined surface (21), external relative to said (20), for engagement of said blade (12) thereagainst, said surface (21) being inclined at 40° to 50° to said axial plane, said blade having a leading end portion engageable with the inclined surface, a lateral engagement bevel (22) on said leading end portion with an inclination greater than the inclination of said inclined surface (21) and comprised between 45° and 55°.

6. Assembly according to claim 1, in which said blade width extends in a circumferential arc of 24° to 32° about said axis of rotation, said blade having a thickness of 2 to 3 mm.

7. Assembly according to claim 6, in which said first wall (19) of the first profiled portion (14) ends at an arcuate distance from the abutment portion (15) which is 1° to 3° less than said width of the blade.

8. Assembly according to claim 6, in which said blade has a following end portion with a lateral bevel (25) for engagement into said V-shaped notch (20), said second wall (16) having an end terminating at a distance from the abutment portion (15) which is at most equal to an arc of 20° about said axis of rotation.

9. Assembly according to claim 8, in which said second wall (16) is extended to the abutment portion (15) and forms a continuous wall (160).

10. Assembly according to claim 1, including screw means on the stopper and the neck for mounting the stopper on the neck, the blade (12) having a free lower end, a bevel (24) on said lower end facing radially outward thus allowing the blade (12) to escape from random engagement resting on the abutment portion (15).

11. Assembly according to claim 10 in which said stopper, fixed on the neck (3), is locked with a selected orientation by less than one and a half screw turns.

12. Assembly according to claim 1, in which said blade (12) has a height of at least 6 mm and engages between said profiled portions (14, 15) over at least ⅔ of its height.

13. Assembly according to claim 1, in which said stopper (1), mounted on the neck (3), is orientated relative to said body (9) by rotation and intervention of said interlocking means (10, 14 and 15).

14. An assembly of a container and stopper, said container including a body with a discharge neck for receiving said stopper thereover in a mounted position, said stopper being rotatable about said neck, an elongate locking blade having a first end fixed to said stopper, said locking blade extending freely from said first end and, in the mounted position, toward said body in radially outward spaced relation to said neck, first and second abutment members fixed to said body radially outward of said neck and rotationally spaced from each other in a direction of rotation of said stopper to define a first space therebetween, said blade in the mounted position of said stopper, rotatably aligning with said first and second abutment members, said first abutment member having a recess therein facing said second abutment member, said recess having an inner end rotationally spaced from said second abutment member to define a second space greater than said first space, said blade having a width in the direction of rotation greater than the first space between the first and second abutment members, and less than the second space between the second abutment member and the inner end of the recess in the first abutment member, at least said blade being radially resiliently flexible relative to the neck in the mounted position of the stopper and snap engageable in a caught position between said abutment members and at least partially into said recess to preclude withdrawal therefrom.

15. Assembly according to claim 14, wherein said recess in said first abutment member is defined by a pair of walls extending from said inner end in laterally spaced relation to each other, one of said walls being elastically flexible in response to engagement of said blade thereagainst as said blade is rotatably aligned between said abutment members.

* * * * *

UNITED STATES PATENT AND TRADEMARK OFFICE

CERTIFICATE OF CORRECTION

PATENT NO. : 5,560,505

DATED : October 1, 1996

INVENTOR(S) : Bernard Schneider and Rene' Hoslet

It is certified that error appears in the above-indentified patent and that said Letters Patent is hereby corrected as shown below:

Column 6, line 31, --notch-- should appear after "said".

Signed and Sealed this

Twenty-sixth Day of November 1996

*Attest:*

BRUCE LEHMAN

*Attesting Officer*

*Commissioner of Patents and Trademarks*